United States Patent [19]

Fuchs

[11] 4,361,961

[45] Dec. 7, 1982

[54] DEVICE FOR MEASURING THE ANGULAR ORIENTATION OF HORIZONTAL BORES

[75] Inventor: Heinz Fuchs, Recklinghausen, Fed. Rep. of Germany

[73] Assignee: Ruhrkohle AG, Essen, Fed. Rep. of Germany

[21] Appl. No.: 257,405

[22] Filed: Apr. 24, 1981

Related U.S. Application Data

[63] Continuation of Ser. No. 92,948, Nov. 9, 1979, abandoned.

[30] Foreign Application Priority Data

Nov. 13, 1978 [DE] Fed. Rep. of Germany ..... 2849147

[51] Int. Cl.[3] ..... E21B 47/02

[52] U.S. Cl. ..... 33/1 H; 33/304; 33/314; 33/391; 33/399

[58] Field of Search ..... 33/1 PT, 174 N, 452, 33/1 N, 1 CC, 304, 343, 312, 169 C, 180 R, 181 R, 309, 308, 172 D, 340, 399, 341, 366, 391

[56] References Cited

U.S. PATENT DOCUMENTS

| | | | |
|---|---|---|---|
| 1,141,396 | 6/1915 | Jubinville | 33/169 C |
| 1,460,279 | 6/1923 | Rosbach | 33/181 R |
| 2,652,628 | 9/1953 | Jensen et al. | 33/343 |
| 2,792,637 | 5/1957 | Seigel et al. | 33/314 |
| 2,906,179 | 9/1959 | Bower | 33/1 CC X |
| 3,065,633 | 11/1962 | Lubinski | 33/312 X |
| 3,200,505 | 8/1965 | Hedges | 33/180 R |
| 3,571,937 | 11/1971 | Sears | 33/312 |
| 3,789,511 | 2/1974 | Groom et al. | 33/312 |
| 4,047,306 | 9/1977 | Otte et al. | 33/314 |

*Primary Examiner*—William D. Martin, Jr.
*Attorney, Agent, or Firm*—Michael J. Striker

[57] ABSTRACT

Two tubular elements are connected by a ball-and-socket joint and arrangements are provided for measuring angular displacement which occurs between the longitudinal center axes of the two elements.

7 Claims, 2 Drawing Figures

DEVICE FOR MEASURING THE ANGULAR ORIENTATION OF HORIZONTAL BORES

This is a continuation of application Ser. No. 92,948, filed Nov. 9, 1979 now abandoned.

BACKGROUND OF THE INVENTION

This invention relates to a device for measuring the angular orientation of horizontal bores.

When horizontal bores are made, particularly underground bores in mining and related activities, it is desired that these bores be either strictly horizontal or be inclined to the horizontal at an angle which is determined in advance. To ascertain that there are no —or no unacceptable— deviations from the predetermined orientation of such bores, the progress of the bore must be measured. At present, this is usually effected with the aid of gyroscopes or compasses. The use of this equipment is not satisfactory, however, because the drift encountered with gyroscopes causes problems and, if compasses are used, the accuracy of their indications is adversely affected by the presence of the magnetizable borehole casing.

SUMMARY OF THE INVENTION

Accordingly, it is an object of the present invention to overcome the disadvantages of the prior art.

A more particular object is to provide a device which is not possessed of the aforementioned disadvantages.

A still more specific object is to provide a device of the type in question which will provide highly accurate measurements.

A concomitant object is to provide such a device which is relatively simple to construct and use, and hence economical to sell and to operate.

Still another object is to provide such a device which permits borehole measurements to be carried out free from external influences, such as occur e.g. in the use of compasses.

In keeping with these objects, and with still others which will become apparent hereafter, one aspect of the invention resides in a device for measuring the angular orientation of horizontal bores. Briefly stated, this device may comprise two tubular elements axially adjacent one another; a ball-and-socket joint connecting the elements with freedom of relative angular displacement; a rigid extension located on the longitudinal center axis of one of the elements and projecting from the joint into the other of the elements; an angle-measuring device carried by the extension within the other element; and means for detecting a relative angular inclination of the center axis and of the longitudinal center axis of the other of the elements.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Both of the embodiments (FIGS. 1 and 2) illustrated herein are shown in somewhat diagrammatic form since certain aspects are known per se in this art and are, therefore, either not illustrated or not shown in detail.

Figure 1:
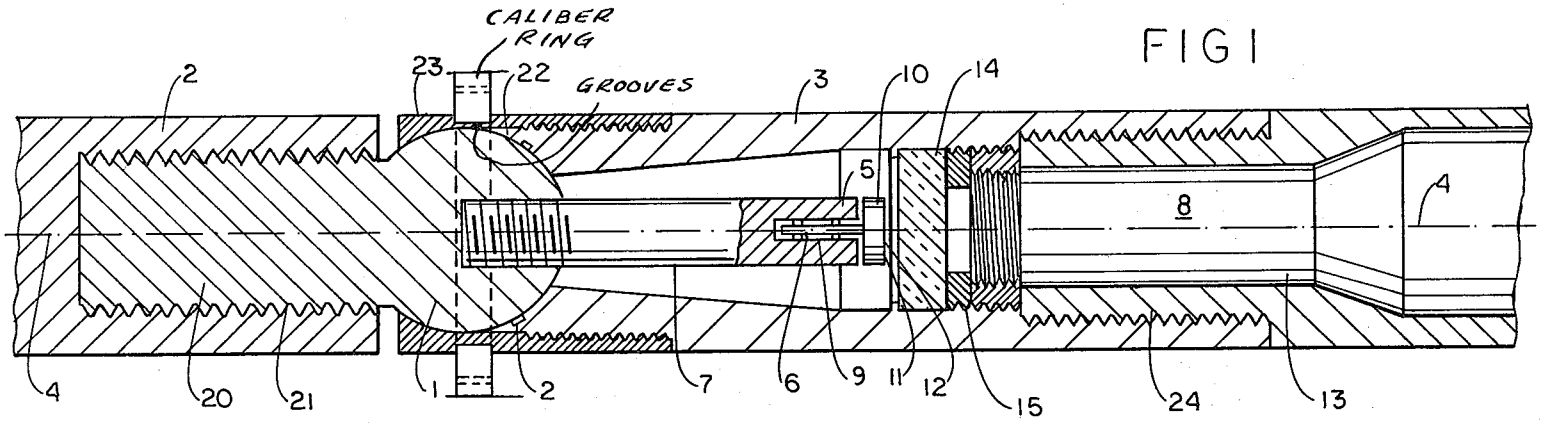
FIG. 1 is a fragmentary longitudinal section through a device embodying the invention.

With this in mind it will be seen that FIG. 1 illustrates a device according to a first embodiment of the invention, having two tubular elements 2, 3 which are preferably of rustfree steel. Each of these elements, which are only partly shown, has a length of about 3 m. One of the elements, here the element 2, has at its adjacent end proximal to the element 3 a tapped recess into which a shaft 20 of the ball 1 of a ball-and-socket joint is inserted by means of threads 21.

The adjacent end portion of the other element, here the element 3, is formed with arcuate surfaces 22 which form the socket for the ball 1. The exterior of this end portion is threaded and a cap nut 23 having a hole through which the shaft 20 extends, is threaded onto this end portion to hold the ball 1 in firm but movable engagement with the surfaces 22. Each element 2, 3 can be centered on the inner surface of the drill pipes through which the device is made to pass, as will be discussed later. Due to the ball-and-socket connection the two elements 2, 3 have three degrees of freedom of rotary movement so that they can adjust themselves to the drill pipes.

The center of the ball 1 is located on the longitudinal axis 4 of the element 2. Ball 1 has a holding device 7 threaded into it which is located on and extends lengthwise of the axis 4; the free end portion 5 of the device 7 is provided with a measuring arrangement in form of a center-of-mass oriented hollow pendulum 10 configurated as a section of a sphere. Pendulum 10 is mounted on a shaft 6 which is rotatably journalled in device 7 via bearings 9, in such a manner that the longitudinal axis of shaft 6 coincides with the axis 4 of element 2.

The endface 11 of the (rotary) pendulum 10 extends normal to the axis 4 of element 2 and faces towards the element 3; it is configurated as a calotte having its center coincident with the axis 4 of element 2. The endface 11 is also provided with a grid 12 of large circles to permit read-out of the angle included between the axes 4, 4 of the elements 2 and 3.

The element 3 has a device 13 installed in it, including a (not separately illustrated because known per se) motion-picture camera and/or pulse generator 8. The device 13 also has a pressure-resistant glass plate 14 (e.g. quartz) in which or on which cross-hairs are provided (not shown) and which is carried by a frame 15 for adjustment of its position. The camera and/or pulse generator can be threaded into a tapped recess of element 3 and receive electrical energy from a not-illustrated battery or battery pack.

The device 8 photographically records the relative incidence of the inclined plane, with reference to the incidence of the longitudinal axis 4 of the element 3 and the angle of inclination in this plane, between the vertical planes defined by the longitudinal axis 4, 4 of element 2, 3. By reduction to a horizontal plane the user obtains the angle between these two vertical planes and in this manner the horizontal component of the angle (located in space) between the axis 4 of element 2 and the axis 4 of element 3 is determined. The vertical component is determined by the sum of the measured relative incidence of the inclined plane and the previously determined true incidence of this inclined plane of the axis 4 of element 2 relative to the axis 4 of element 3.

The device in FIG. 1 is inserted into the drill pipes (not shown) and pulled through them in direction from element 3 towards element 2, i.e. with element 2 leading. In so doing one obtains the refraction angles of a polygonal traverse having sides of 3 m length, as the orthogonal parallel projection of this traverse onto a horizontal plane and in the vertical plane developed thereon. Since the polygonal traverse is identical with the position of the bore in space, one obtains an illustration of the bore in plan view and in section. For the plan view the 3 m length must be reduced, in correspondence with the true incidence of the respective inclined plane.

Figure 2:
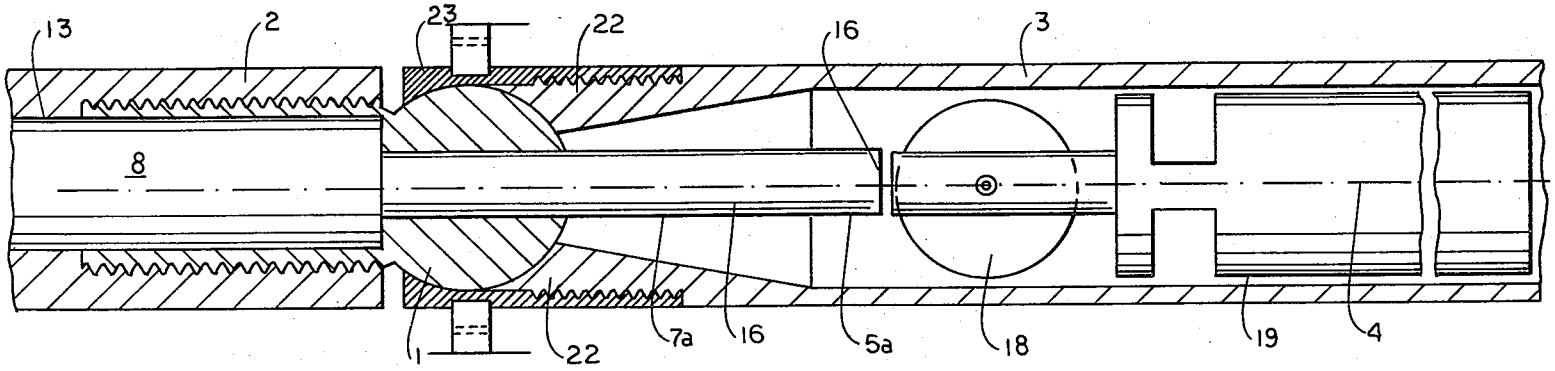
FIG. 2 is a view analogous to FIG. 1 but of a different embodiment of the invention.

In the embodiment of FIG. 2 like references have been used to designate elements corresponding to those in FIG. 1.

In FIG. 2 the device 13 with the camera and/or impulse generator 8 is mounted in the element 2, instead of the element 3. The holding device *7a*, which is here located in element 3, is configurated as a tube 17 the free end portion *5a* is provided with cross-hairs 16. The counterpart of pendulum 10 from FIG. 1 is here a center-of-gravity oriented cylinder 19 which is journalled to be rotatable about the axis 4 of element 3. The cylinder 19 accommodates in its interior an electronic scanning and storage device and its front endface (the leftward facing one in FIG. 2) is provided with a grid or reticule. Located between the cross-hairs 16 and the pendulum 19 is a center-of-gravity oriented circular member 18 which is turnable about the axis 18*a*. The operation of the device in FIG. 2 is the same as the one in FIG. 1.

The term "center-of-gravity oriented" as used herein means that the respective element is so weighted as to have an eccentric center of gravity which causes the device to turn about its axis until the center of gravity has reached the lowest point.

While the invention has been illustrated and described as embodied in a device for measuring the angular orientation of horizontal bores, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Device for measuring the angular orientation of horizontal bores, comprising two discrete tubular elements having respective ends axially adjacent one another, a ball-and-socket joint in one of said adjacent ends for connecting said tubular elements with freedom of relative angular displacement and having one rigid extension projecting from said one end into and being anchored in the other of said ends, and a second rigid extension located on the longitudinal center axis of one of said tubular elements and projecting from said joint into the other of said tubular elements, said second rigid extension having a free end portion spaced from said joint, a support member adjacent said free end portion; an angle-measuring device carried by one of said support member and said free end portion; said device being operative for detecting the occurrence and magnitude of successive relative angular inclinations of the longitudinal center axes of said tubular elements and including a center of gravity oriented pendulum, and optical discrete means operative for optically detecting a continuing record of information provided by said measuring device.

2. Device as defined in claim 1, said center-of-gravity oriented pendulum is hollow and has an endface directed towards said other element, said angle-measuring device further comprising a shaft having an axis of rotation coincident with said center axis of said one element, and bearings journalling said shaft for rotation about said axis of rotation.

3. Device as defined in claim 2, said endface having a measuring reticule, and said means comprising a pressure-resistant transparent plate spaced from said hollow pendulum, said support member including a frame mounting said plate for adjustment in said other element, and cross-hairs viewable through said transparent plate.

4. Device as defined in claim 1, said second rigid extension being tubular and having said free end portion provided with cross-hairs, and said angle measuring device comprising a circular member mounted on said support member and located in a vertical plane passing through the longitudinal axis of said other tubular element, said center-of-gravity oriented pendulum being connected to said circular member and being turnable about said longitudinal center axis of said other tubular element.

5. Device as defined in claim 1, said one element having an axial tapped recess, and the ball of said joint having a rigid threaded projection which is threadedly received in said tapped bore.

6. Device as defined in claim 1, said other element having an end portion adjacent said one element and provided with sections having part-circular faces which together define the socket of said joint, and a cap nut threaded onto said endportion to hold said ball in said socket.

7. Device as defined in claim 1, said means comprising a unit having a threaded body portion which is threadable into a tapped recess of said other element.

* * * * *